United States Patent [19]

Palmer

[11] 4,068,775

[45] Jan. 17, 1978

[54] SEALABLE CONTAINER DEVICE

[75] Inventor: Guy V. Palmer, Inkster, Mich.

[73] Assignee: The Raymond Lee Organization, Inc., New York, N.Y. ; a part interest

[21] Appl. No.: 755,796

[22] Filed: Dec. 30, 1976

[51] Int. Cl.[2] ..... B65D 41/06

[52] U.S. Cl. ..... 215/331; 215/344

[58] Field of Search ..... 215/331, 344, 329; 150/.5

[56] References Cited

U.S. PATENT DOCUMENTS

| | | | |
|---|---|---|---|
| 495,299 | 4/1893 | Calcutt | 215/331 |
| 624,509 | 5/1899 | Lessing | 215/329 |
| 1,304,098 | 5/1919 | Rivers | 215/331 |
| 1,313,264 | 8/1919 | Cooney | 215/329 |
| 1,365,274 | 1/1921 | Rivers | 215/331 |
| 1,459,589 | 6/1923 | Hoffman | 215/331 |
| 1,499,612 | 7/1924 | Hammer | 215/331 |
| 1,849,523 | 3/1932 | Hammer | 215/331 |
| 2,403,131 | 7/1946 | Smith | 215/331 |
| 3,822,027 | 7/1974 | Cherba | 215/329 |
| 3,830,395 | 8/1974 | Crisci | 150/.5 |

*Primary Examiner*—Ro E. Hart

*Attorney, Agent, or Firm*—Daniel Jay Tick

[57] ABSTRACT

An annular flange extends radially from the rim around the open top of a container in a plane perpendicular to the axis of the container. The flange is integrally formed with the container and has a plurality of notches formed therein and extending radially inwardly from the outer edge of the flange. The flange has a planar top surface and tapered bottom surfaces forming a plurality of inverted inclined planes relative to the top surface, each extending from one of the notches to the next-adjacent notch in the same direction around the flange. A lid has a plurality of lock members formed thereon in the same angular relation as the notches of the container whereby each of the lock members is simultaneously passable through a corresponding one of the notches of the flange of the container. Each of the lock members comprises an arm supported by the lid and extending parallel to the lid in spaced relation below the lid in a manner whereby when the lid is positioned on the container with the lock members in alignment with the notches of the flange and such members are passed through the notches and the lid is turned, the arms of the lock members move into abutment with the bottom surfaces of the flange. If the lid is further turned, the arms securely seal the lid to the container via the flange.

2 Claims, 5 Drawing Figures

SEALABLE CONTAINER DEVICE

BACKGROUND OF THE INVENTION

The present invention relates to a sealable container device.

Objects of the invention are to provide a sealable container device of simple structure, which is inexpensive in manufacture, reusable to provide an airtight or pressure seal a great number of times, used with facility and convenience to provide and break a pressure seal, and functions efficiently, effectively and reliably, when sealed, as a canning container for home canning of food products.

BRIEF DESCRIPTION OF THE DRAWINGS:

In order that the invention may be readily carried into effect, it will now be described with reference to the accompanying drawings, wherein.

Figure 1:
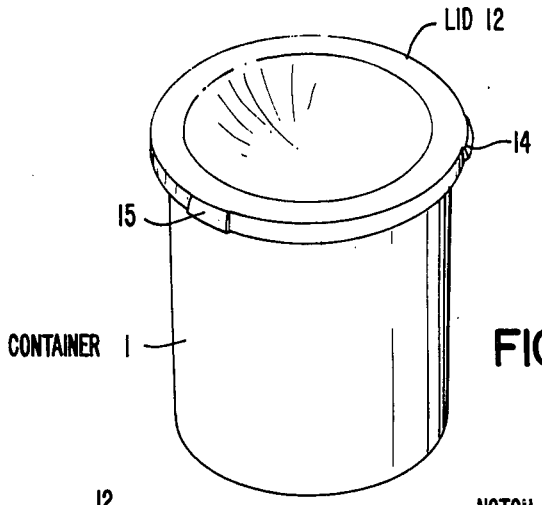
FIG. 1 is a perspective view of an embodiment of the sealable container device of the invention.
Figure 2:
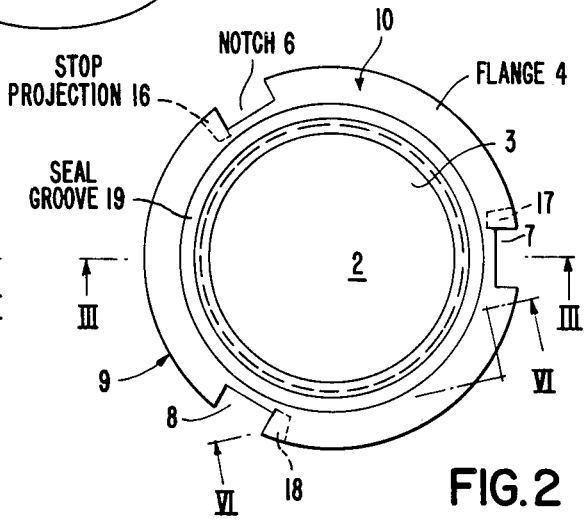
FIG. 2, is a top axial view of an embodiment of the container of the invention without its lid.
Figure 5:
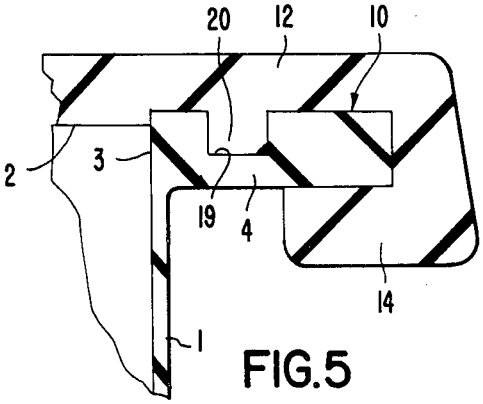
FIG. 5 is a cross-sectional view, on an enlarged scale, taken along the lines V—V, of FIG. 4.
Figure 3:
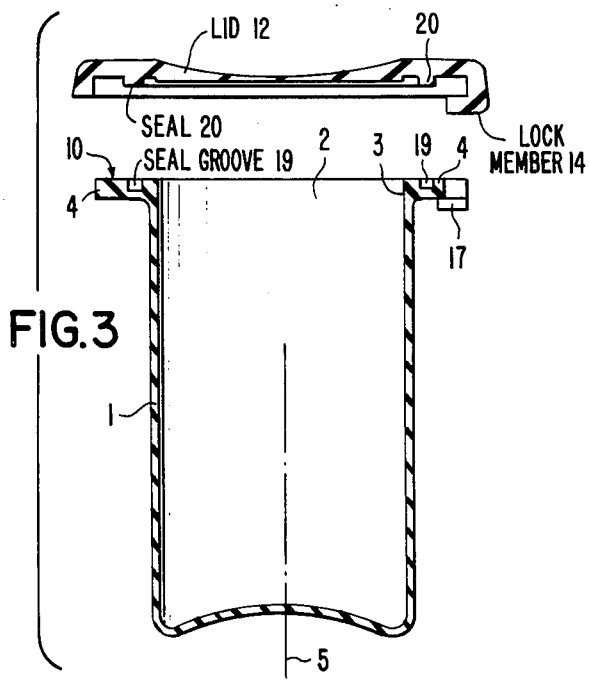
FIG. 3 is a cross-sectional view of the container of FIG. 2 taken along the lines III—III, of FIG. 2, and a cross-sectional view of the lid of the container device of the invention in spaced relation with the container.

DETAILED DESCRIPTION OF THE INVENTION:

The sealable container device of the invention comprises a container 1 (FIGS. 1, 3 and 5) having an open top 2 (FIGS. 2, 3 and 5) with the rim 3 therearound (FIGS. 2, 3 and 5). A substantially annular flange 4 extends substantially radially from the container 1 at the rim 3 thereof in a plane substantially perpendicular to the axis 5 of the container (FIGS. 2, 3, 5 and 6).

The flange 4 is integrally formed with the container 1 and has a plurality of notches 6, 7 and 8 formed therein and extending substantially radially inwardly from the outer edge 9 of said flange, as shown in FIG. 2. The flange 4 has a substantially planar top surface 10 (FIGS. 2, 3, 5 and 6) and tapered bottom surfaces forming a plurality of inverted inclined planes relative to the top surface, each of said bottom surfaces extending from one of the notches to the next-adjacent notch in the same direction around the flange. Thus, a first tapered bottom surface forms an inverted inclined plane relative to the top surface 10 extending from the notch 6 to the notch 7 in a clockwise direction (FIG. 2). A second tapered bottom surface 11 forms an inverted inclined plan relative to the top surface 10 (FIGS. 2 and 6) extending from the notch 7 to the notch 8 in clockwise direction. A third tapered bottom surface (FIG. 2) forms an inverted inclined plane relative to the top surface 10, extending from the notch 8 to the notch 6 in clockwise direction.

Figure 6:
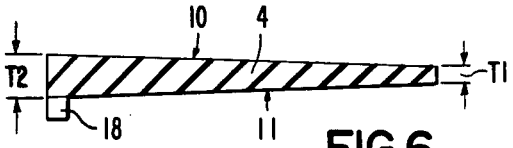
FIG. 6 is a cross-sectional view, taken along the lines VI—VI, of FIG. 2.

As shown in FIG. 6, the bottom surface 11 is spaced a distance T1 from the top surface 10 at its end adjacent the notch 7, whereas said bottom surface is spaced a distance T2 from said top surface adjacent the notch 8, the distance T2 being greater than the distance T1.

Figure 4:
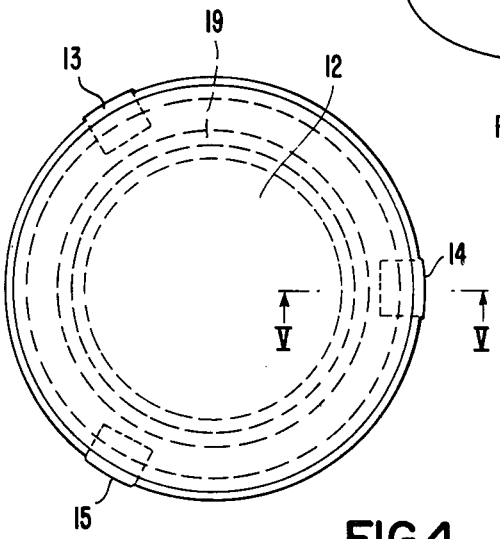
FIG. 4 is a top axial view of the embodiment of FIGS. 2 and 3 with the lid on the container.

A lid 12 (FIGS. 1 and 3 to 5) has a plurality of lock members 13, 14 and 15 formed thereon in the same angular relationship as the notches 6, 7 and 8 of the container 1 (FIG. 4) whereby each of the lock members is simultaneously passable through a corresponding one of the notches of the flange 4 of said container. Thus, in the illustrated embodiment of the invention, the notches 6, 7 and 8 are mutually equiangularly spaced by 120°, and the lock members 13, 14 and 15 are so spaced.

Each of the lock members 13, 14 and 15 comprises an arm supported by the lid 12 and extending substantially parallel to the lid in spaced relation below said lid in a manner whereby when the lid is positioned on the container 1, with the lock members in alignment with the notches 6, 7 and 8 of the flange 4, and the lock members are passed through said notches, and the lid is turned in a clockwise direction, the arms of the lock members move into abutment with the bottom surfaces of the flange. If the lid 12 is further turned in a clockwise direction, the arms securely seal the lid to the container 1 via the flange 4. One of the three lock members 14 is shown in FIGS. 3 and 5.

The lid 12 preferably has a concave top surface to enable expansion under pressure during a canning process.

A plurality of stop projections 16, 17 and 18 (FIGS. 2, 3 and 6) are provided. The stop projections 16, 17 and 18 extend from the three surfaces of the flange 4 at the notches 6, 7 and 8, respectively, as shown in FIG. 2. Each of the stop projections 16, 17 and 18 is provided at the area of maximum flange thickness T2 (FIG. 6) between the top and bottom surfaces 10 and 11 of the flange. Thus, when the lid 12 is manually rotated in a clockwise direction, if a tight seal is not made between the lock members 13, 14 and 15 of the lid and the bottom surfaces of the flange 4 prior to a rotation of 120° of said lid, the stop projections 16, 17 and 18 will prevent said lid from extending beyond one third revolution and insure that said lid remains in its pressure tight position.

A circular seal groove 19 (FIGS. 2 to 5) is formed in the top surface 10 of the flange 4 in spaced relation with the notches 6, 7 and 8 thereof. A corresponding circular seal protrusion 20 (FIGS. 3 and 5) extends from the bottom of the lid 12. The seal protrusion 20 fits in the seal groove 19 when the lid is fixed in position on the container 1, thereby sealing the container.

While the invention has been described by means of a specific example and in a specific embodiment, I do not wish to be limited thereto, for obvious modifications will occur to those skilled in the art without departing from the spirit and scope of the invention.

I claim:

1. A sealable canning container device, comprising a container having an open top with a rim therearound, a substantially annular flange extending substantially radially from the container at the rim thereof in a plane substantially perpendicular to the axis of the container, said flange being integrally formed with the container and having a plurality of notches formed therein and extending substantially radially inwardly from the outer edge of the flange, said flange having a substantially planar top surface and tapered bottom surfaces forming a plurality of inverted inclined planes relative to the top surface, each extending from one of the notches to the next-adjacent notch in the same direction around the flange;

a lid having a plurality of lock members formed thereon in the same angular relationship as the notches of the container whereby each of the lock members is simultaneously passable through a corresponding one of the notches of the flange of the container, each of said lock members comprising an arm supported by the lid and extending substantially parallel to the lid in spaced relation below said lid in a manner whereby when the lid is positioned on the container with the lock members in alignment with the notches of the flange and the lock members are passed through the notches and the lid is turned, the arms of the lock members move into abutment with the bottom surfaces of the flange, and if the lid is further turned, said arms securely seal said lid to said container via said flange to provide a seal strong enough to preserve perishable foods for years;

a plurality of stop projections each extending from a bottom surface of the flange at a corresponding one of the notches at the area of maximum flange thickness between top and bottom surfaces; and a circular groove formed in the top surface of the flange in spaced relation with the notches thereof and a corresponding circular protrusion extending from the bottom of the lid for fitting in the groove and sealing the container.

2. A sealable canning container device as claimed in claim 1, wherein the lid has a concave top surface to enable expansion under pressure during a canning process.

* * * * *